US012162573B1

(12) United States Patent
Ding et al.

(10) Patent No.: US 12,162,573 B1
(45) Date of Patent: Dec. 10, 2024

(54) THROWING PROTECTION APPARATUS FOR ADAPTIVE NAVIGATION SITUATION AWARENESS DEVICE BASED ON SHIP PILOTAGE

(71) Applicant: CHINA WATERBORNE TRANSPORT RESEARCH INSTITUTE, Beijing (CN)

(72) Inventors: Gege Ding, Beijing (CN); Chunxu Li, Beijing (CN); Xiongfei Geng, Beijing (CN); Jie Wen, Beijing (CN); Jianan Luo, Beijing (CN)

(73) Assignee: CHINA WATERBORNE TRANSPORT RESEARCH INSTITUTE, Beijing (CN)

( * ) Notice: Subject to any disclaimer, the term of this patent is extended or adjusted under 35 U.S.C. 154(b) by 0 days.

(21) Appl. No.: 18/819,225

(22) Filed: Aug. 29, 2024

(30) Foreign Application Priority Data

Sep. 1, 2023 (CN) ..... 202311122245.7

(51) Int. Cl.
*B63B 69/00* (2013.01)

(52) U.S. Cl.
CPC ..... *B63B 69/00* (2013.01); *B63B 2221/00* (2013.01)

(58) Field of Classification Search
CPC ..... B63B 69/00; B63B 2221/00
See application file for complete search history.

(56) References Cited

U.S. PATENT DOCUMENTS

| | | | | |
|---|---|---|---|---|
| 11,334,078 | B1 | 5/2022 | Kim | |
| 2018/0284762 | A1 | 10/2018 | Green | |
| 2019/0375504 | A1* | 12/2019 | Schmalzried | B64U 70/90 |

FOREIGN PATENT DOCUMENTS

| | | | | |
|---|---|---|---|---|
| CN | 106828935 | A | 6/2017 | |
| CN | 112339928 | A | 2/2021 | |
| CN | 112744226 | A | 5/2021 | |
| CN | 215205373 | U | 12/2021 | |
| CN | 216034999 | U | 3/2022 | |
| CN | 114524105 | A | 5/2022 | |
| CN | 217333393 | U | 8/2022 | |
| CN | 116654329 | A | 8/2023 | |
| EP | 2213570 | A2 * | 8/2010 | B64C 37/00 |
| KR | 20150140891 | A | 12/2015 | |

* cited by examiner

*Primary Examiner* — Stephen P Avila
(74) *Attorney, Agent, or Firm* — Birchwood IP

(57) ABSTRACT

A throwing protection apparatus for an adaptive navigation situation awareness device based on ship pilotage comprises: a connecting apparatus, a landing buffer apparatus, a fixing apparatus, a pressing apparatus, a shell and a control apparatus; wherein a bottom of the shell is provided with an opening for the adaptive navigation situation awareness device to pass through; one end of the connecting apparatus is fixedly connected to an unmanned aerial vehicle, and the other end of the connecting apparatus is slidably connected to the shell; the adaptive navigation situation awareness device is arranged in the shell and is fixed by the fixing apparatus arranged on the shell; the pressing apparatus is mounted on the shell and is positioned above the adaptive navigation situation awareness device; the landing buffer apparatus is mounted outside the shell; and an air bag and a distance measuring sensor are fixedly mounted on the shell.

6 Claims, 23 Drawing Sheets

THROWING PROTECTION APPARATUS FOR ADAPTIVE NAVIGATION SITUATION AWARENESS DEVICE BASED ON SHIP PILOTAGE

CROSS-REFERENCE TO RELATED APPLICATIONS

This application claims priority to Chinese Patent Application No. 202311122245.7, filed on Sep. 1, 2023, which is hereby incorporated by reference in its entirety.

TECHNICAL FIELD

The present invention relates to the technical field of ships, and in particular, to a throwing protection apparatus for an adaptive navigation situation awareness device based on ship pilotage.

BACKGROUND

Ship entering and berthing is the most risky part of the entire voyage. The complexity of the water area environment of the port poses a great challenge to the ship pilot. With the development of large-scale ships, the ship berthing incidents increase year by year.

Most pilotage and berthing incidents are caused by insufficient information on the ship attitude, which leads to misjudgment and improper operation by the pilot. Commonly used navigation aids such as shipborne radars and GPS navigation positioning are difficult to provide intuitive, accurate and real-time ship attitude information. Although the pilotage equipment carried by the pilot and used on ship can also reflect the position information of the ship during navigation, the weight and volume of this pilotage equipment increase the safety risk of the pilot when boarding and leaving the ship by a soft ladder.

In response to the demand for ship navigation situation information and berth distance measurement during ship pilotage and berthing, the present invention innovatively proposes a throwing protection apparatus for an adaptive navigation situation awareness device based on ship pilotage. This apparatus can throw the adaptive navigation situation awareness device for ship pilotage onto the ship smoothly and safely under the drive of an unmanned aerial vehicle, thus effectively avoiding the safety risks brought by the pilot boarding and leaving the ship.

SUMMARY

To solve the problems in the background, the present invention provides a throwing protection apparatus for an adaptive navigation situation awareness device based on ship pilotage. The specific technical solution is as follows:

A throwing protection apparatus for an adaptive navigation situation awareness device based on ship pilotage comprises: a connecting apparatus, a landing buffer apparatus, a fixing apparatus, a pressing apparatus, a shell and a control apparatus; a bottom of the shell is provided with an opening for the adaptive navigation situation awareness device to pass through; one end of the connecting apparatus is fixedly connected to an unmanned aerial vehicle, and the other end of the connecting apparatus is slidably connected to the shell; the adaptive navigation situation awareness device is arranged in the shell and is fixed by the fixing apparatus arranged on the shell; the pressing apparatus is mounted on the shell, is positioned above the adaptive navigation situation awareness device and is configured to press the adaptive navigation situation awareness device downward; the landing buffer apparatus is mounted outside the shell;

a bottom plate turnover mechanism, a fixing mechanism and a second fixing mechanism are arranged on the fixing apparatus; the bottom plate turnover mechanism is rotatably mounted at a bottom end of the shell, and the fixing mechanism is fixedly mounted on the bottom plate turnover mechanism; when the bottom plate turnover mechanism is at a certain distance from a shipboard, the bottom plate turnover mechanism rotates to enable the fixing mechanism to be perpendicular to the shipboard, and the fixing mechanism fixedly mount the throwing protection apparatus for the adaptive navigation situation awareness device on the shipboard; the second fixing mechanism is fixedly connected between the shell and the adaptive navigation situation awareness device;

an air bag and a distance measuring sensor are fixedly mounted on the shell; and the control apparatus is configured to control the operation of the entire throwing protection apparatus for the adaptive navigation situation awareness device based on ship pilotage except for the control apparatus.

Further, a fixed disk, a fixed frame, an air cylinder and a push rod are arranged on the connecting apparatus; the fixed disk is fixedly mounted on the unmanned aerial vehicle; at least two fixed frames are uniformly distributed and fixedly mounted on the fixed disk, and a limiting rod is elastically and slidably mounted at the other end of the fixed frame horizontally; the shell is provided with a sliding groove corresponding to one end of the limiting rod; the number of the push rods corresponds to that of the limiting rods; the limiting rod is provided with a through hole, and the push rod is slidably mounted in the through hole of the limiting rod and is driven by the air cylinder fixedly mounted on the fixed disk; and the push rod is provided with an inclined plane a and is configured to push one end of the limiting rod into the sliding groove in the shell under the drive of the air cylinder.

Further, a second fixed frame, a first arc-shaped rod, a second arc-shaped rod and a third fixed frame are arranged on the landing buffer apparatus; two second fixed frames are symmetrically and fixedly mounted on the shell in a front-back manner; the third fixed frame is fixedly mounted on the shell; two ends of the second arc-shaped rod are fixedly mounted on the second fixed frame; two ends of the first arc-shaped rod are rotatably mounted on the second fixed frame, correspond to the second arc-shaped rod and are driven by a first motor fixedly mounted on the third fixed frame; and the first arc-shaped rod and the second arc-shaped rod are connected by soft fabric.

Further, a driving mechanism, a bottom plate and a support rod are arranged on the bottom plate turnover mechanism; ends of four support rods are symmetrically and fixedly mounted on the shell in a front-back manner; two third fixed frames are symmetrically and fixedly mounted on the shell in a front-back manner; and two bottom plates are symmetrically arranged in a front-back manner, are rotatably mounted between the support rods at corresponding two sides, and are synchronously driven by the driving mechanism mounted on the third fixed frame.

Further, a special-shaped circular plate and a fixed rod are arranged on the bottom plate turnover mechanism; two fixed rods are fixedly mounted on the bottom plate; and two special-shaped circular plates are fixedly mounted on the third fixed frame, are driven by a corresponding second motor fixedly mounted on the third fixed frame, and are intermittently matched with a fixed rod to fix two overturned bottom plates.

Further, a rotating shaft, a second rotating shaft, a third rotating shaft, a fourth rotating shaft and a fifth rotating shaft are arranged on the driving mechanism; the rotating shaft and the second rotating shaft are rotatably mounted on the third fixed frame at a front side and are in transmission connection by a second belt to achieve synchronous rotation; an output end of the first motor is fixedly connected to a first bevel gear, one end of the rotating shaft is fixedly connected to a second bevel gear, and the first bevel gear is engaged with the second bevel gear;

the third rotating shaft is rotatably mounted between two support rods at a front side and is fixedly connected to the bottom plate between the two support rods; a first gear is fixedly mounted on the second rotating shaft, and a second gear is fixedly mounted on one end of the third rotating shaft corresponding to the second rotating shaft; the first gear is engaged with the second gear;

the fourth rotating shaft is rotatably mounted on the third fixed frame at a rear side and is in transmission connection with the third rotating shaft through a third belt;

the fifth rotating shaft is rotatably mounted between two support rods at a rear side and is fixedly connected to the bottom plate between the two support rods; a third gear is fixedly mounted on the fourth rotating shaft, and a fourth gear is fixedly mounted at one end of the fifth rotating shaft corresponding to the fourth rotating shaft; and the third gear is engaged with the fourth gear.

Further, two fixing mechanisms are symmetrically and fixedly mounted on the bottom plate; each of the fixing mechanisms is provided with an air pump, a support frame, a fixed plate, a rotating disk and a third motor; two support frames are symmetrically and fixedly mounted on the bottom plate; two rotating disks are rotatably mounted on the support frame and are driven by the third motor fixedly mounted on the bottom plate; the fixed plate is fixedly mounted between the two rotating disks; and a plurality of suction disks are fixedly mounted on the fixed plate and are connected in series through an air pipe, and one end of the air pipe is connected to the air pump.

Further, an electric lead screw apparatus and a pressing plate are arranged on the pressing apparatus; the electric lead screw apparatus is mounted on the shell; and the pressing plate is mounted inside the shell in an up-and-down sliding manner, corresponds to the adaptive navigation situation awareness device, is positioned at an upper end of the adaptive navigation situation awareness device, and is driven by the electric lead screw apparatus.

Further, a second fixing mechanism is further arranged on the fixing apparatus, one end of the second fixing mechanism is fixedly connected to the inside of the shell, and the other end of the second fixing mechanism is fixedly connected to the outside of the adaptive navigation situation awareness device.

Further, the second fixing mechanism comprises a second spring; and a plurality of the second springs are symmetrically distributed in front and behind the adaptive navigation situation awareness device, one end of each of the springs is fixedly connected to the inside of the shell, and the other end of each of the springs is fixedly connected to the outside of the adaptive navigation situation awareness device.

Compared with the prior art, the present invention has the following advantages:

(1) According to the present invention, the adaptive navigation situation awareness device can be thrown onto the shipboard by the unmanned aerial vehicle, so that there is no need for a pilot to carry the adaptive navigation situation awareness device to board the ship, and the safety risk caused by pilot boarding and leaving the ship is effectively avoided.

(2) According to the present invention, the collision force suffered by the adaptive navigation situation awareness device in the throwing process can be reduced by the landing buffer apparatus and the fixing apparatus, so that the adaptive navigation situation awareness device can be more safely landed on the shipboard.

(3) According to the present invention, the adaptive navigation situation awareness device can be fixed on the shipboard by the fixing apparatus and will not move due to the swaying of the hull, so that the occurrence of inaccurate detection data caused by the movement of the adaptive navigation situation awareness device is avoided.

(4) According to the present invention, the air bag can make the adaptive navigation situation awareness device float on the sea surface. Even if the device falls into the water due to an accident, it is more convenient to recover this device and reduce the loss.

1—connecting apparatus;

101—fixed disk, 102—first spring, 103—fixed frame, 104—moving plate, 105—air cylinder, 106—push rod, 10601—inclined plane a, 107—limiting rod, 10701—through hole;

2—landing buffer apparatus;

201—second fixed frame, 202—first arc—shaped rod, 203—second arc—shaped rod, 204—third fixed frame, 205—first motor, 206—belt;

3—fixing apparatus;

31—bottom plate turnover mechanism, 3101—second motor, 3102—special—shaped circular plate, 3103—bottom plate, 3104—fixed rod, 31A—driving mechanism, 3105—support rod, 3106—first bevel gear, 3017—second bevel gear, 3108—rotating shaft, 3109—second belt, 3110—second rotating shaft, 311001—first gear, 3111—third rotating shaft, 311101—second gear, 3112—third belt, 3113—fourth rotating shaft, 311301—third gear, 3114—fifth rotating shaft, 311401—fourth gear; 32—fixing mechanism, 3201—air pump, 3202—suction disk, 3203—support frame, 3204—fixed plate, 3205—rotating disk, 3206—third motor, 3207—air pipe; 33—second fixing mechanism, 3301—second spring;

4—pressing apparatus;

401—electric lead screw apparatus, 402—pressing plate, 403—sliding rod;

5—air bag;

6—shell;

601—opening; 602—sliding groove;

7—sensor;

8—control apparatus;

9—unmanned aerial vehicle;

10—adaptive navigation situation awareness device; and

11—shipboard.

DETAILED DESCRIPTION OF THE EMBODIMENTS

To make those skilled in the art better understand the technical solutions of the present invention, the technical solutions in the embodiments of the present invention will be clearly and completely described below. Apparently, the described embodiments are merely a part, rather than all of the embodiments of the present invention. Based on the embodiments of the present invention, all other embodiments obtained by those of ordinary skill in the art without creative effort should fall within the protection scope of the present invention.

Embodiment

Figure 1:
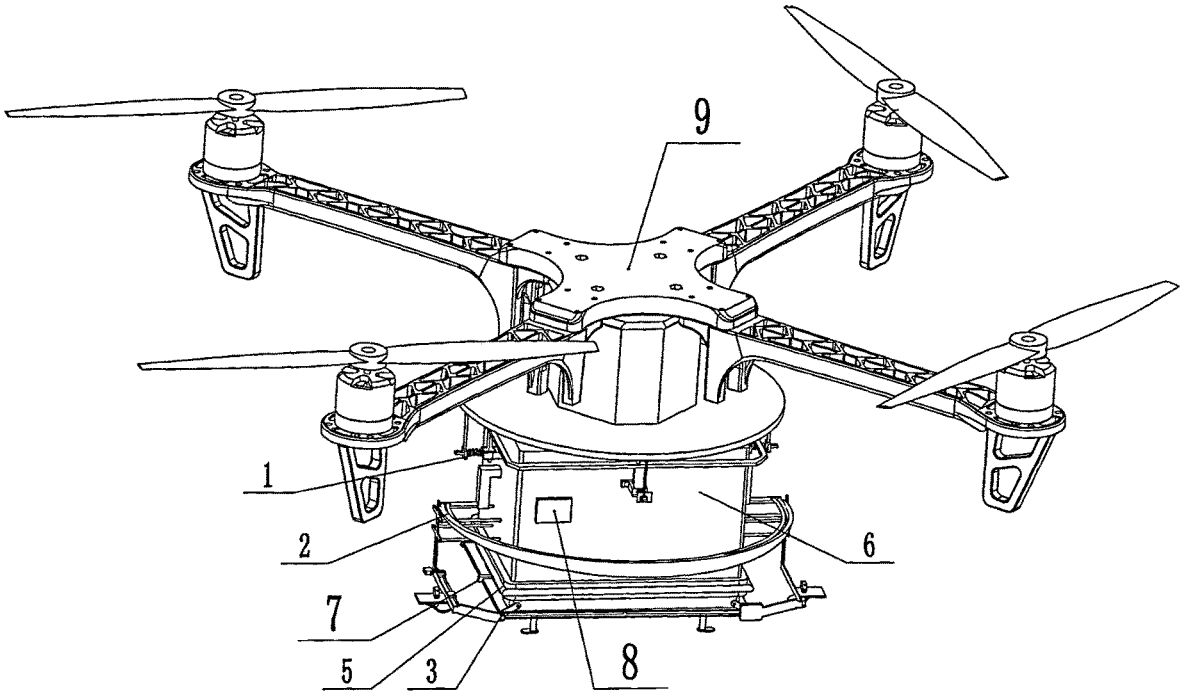
FIG. 1 is a schematic diagram of an assembly structure of the present invention and an unmanned aerial vehicle.
Figure 2:
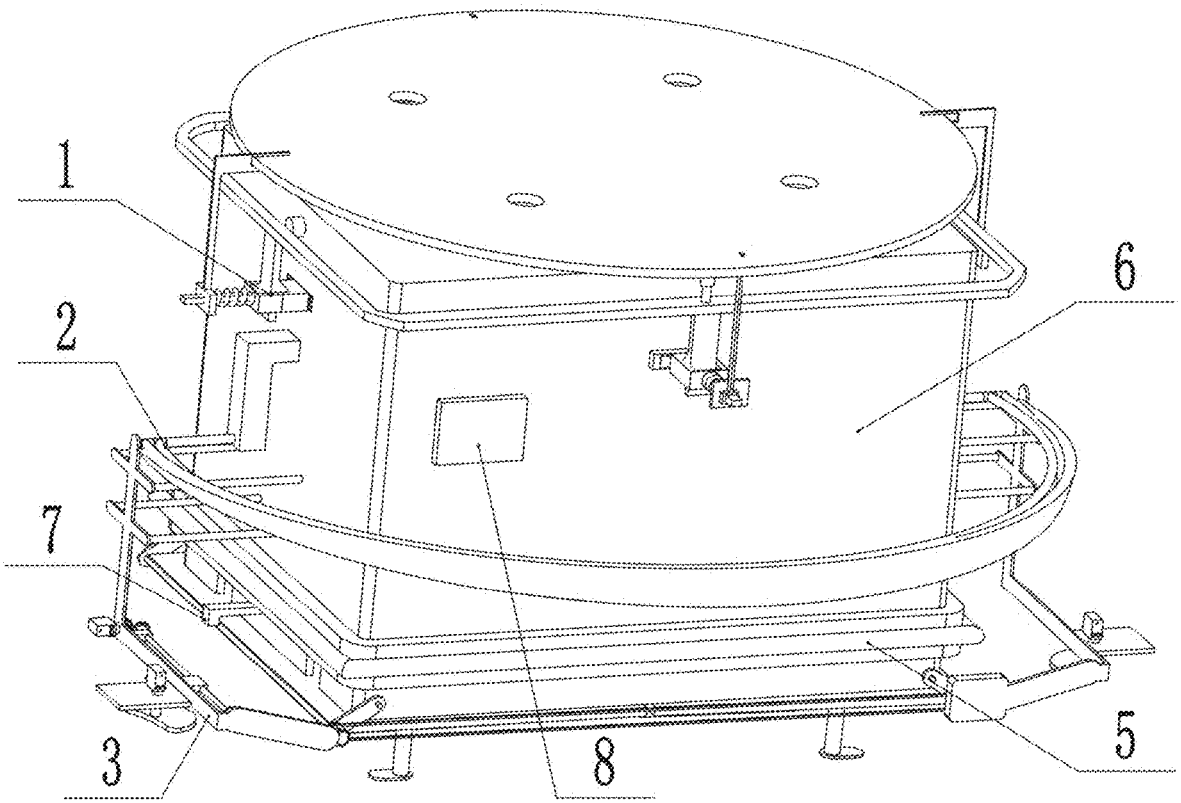
FIG. 2 is a schematic diagram of an assembly structure of the present invention.
Figure 3:
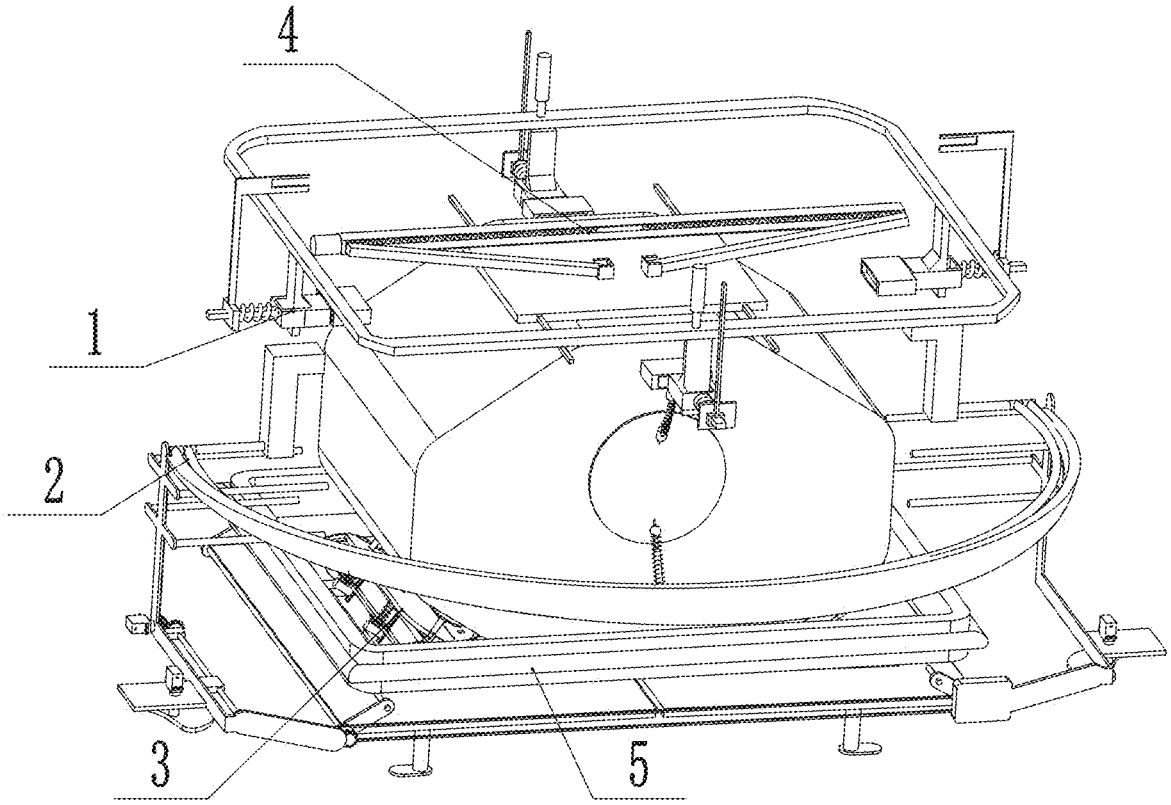
FIG. 3 is a schematic diagram of an internal assembly structure of the present invention with a shell removed.

As shown in FIGS. 1 to 3, a throwing protection apparatus for an adaptive navigation situation awareness device 10 based on ship pilotage comprises: a connecting apparatus 1, a landing buffer apparatus 2, a fixing apparatus 3, a pressing apparatus 4 and a shell 6; a bottom of the shell 6 is provided with an opening 601 for the adaptive navigation situation awareness device 10 to pass through; one end of the connecting apparatus 1 is fixedly connected to an unmanned aerial vehicle 9, and the other end of the connecting apparatus is slidably connected to the shell 6; the adaptive navigation situation awareness device 10 is arranged in the shell 6, and the adaptive navigation situation awareness device 10 is fixed by the fixing apparatus 3 arranged on the shell 6; the pressing apparatus 4 is mounted on the shell 6, is positioned above the adaptive navigation situation awareness device 10 and is configured to press the adaptive navigation situation awareness device 10 downward; and the landing buffer apparatus 2 is mounted outside the shell 6. The adaptive navigation situation awareness device 10 in this embodiment is a conventional device, which is specifically in a brand of Xsens, a model of MTi-680(G) RTK GNSS/INS, and a size of 56 mm×41 mm×37 mm in length, width and height.

A bottom plate turnover mechanism 31, a fixing mechanism 32 and a second fixing mechanism 33 are arranged on the fixing apparatus 3; the bottom plate turnover mechanism 31 is rotatably mounted at a bottom end of the shell 6, and the fixing mechanism 32 is fixedly mounted on the bottom plate turnover mechanism 31; when the bottom plate turnover mechanism 31 is at a certain distance from a shipboard 11, the bottom plate turnover mechanism rotates to enable the fixing mechanism 32 to be perpendicular to the shipboard 11, and the fixing mechanism 32 fixedly mount this device on the shipboard 11; and the second fixing mechanism 33 is fixedly connected between the shell 6 and the adaptive navigation situation awareness device 10.

An air bag 5 is fixedly mounted on an outer bottom of the shell 6, and the air bag 5 is positioned above the bottom plate turnover mechanism 31, so that the air bag and the bottom plate turnover mechanism cannot interfere with each other.

A sensor 7 configured to measure a distance is fixedly mounted outside the shell 6, and the sensor 7 is specifically positioned between the bottom plate turnover mechanism 31 and the air bag 5 and configured to measure a distance between the shell 6 and the shipboard 11.

A control apparatus 8 is configured to control the operation of the entire throwing protection apparatus for the adaptive navigation situation awareness device 10 based on ship pilotage except for the control apparatus. In this embodiment, the control apparatus 8 is electrically connected to a remote controller for operating an unmanned aerial vehicle 9, and the operator can control the operation of the unmanned aerial vehicle 9 and the throwing protection apparatus by operating the remote controller for operating the unmanned aerial vehicle 9.

Figure 4:
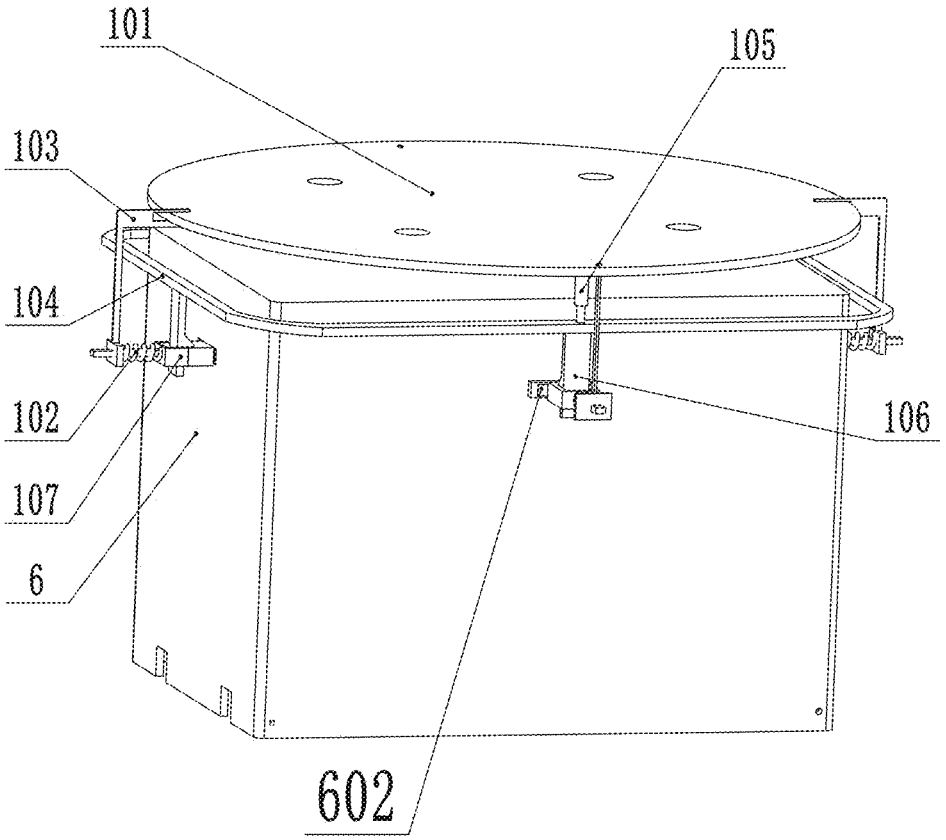
FIG. 4 is a schematic diagram of an assembly structure of a connecting apparatus and a shell according to the present invention.
Figure 5:
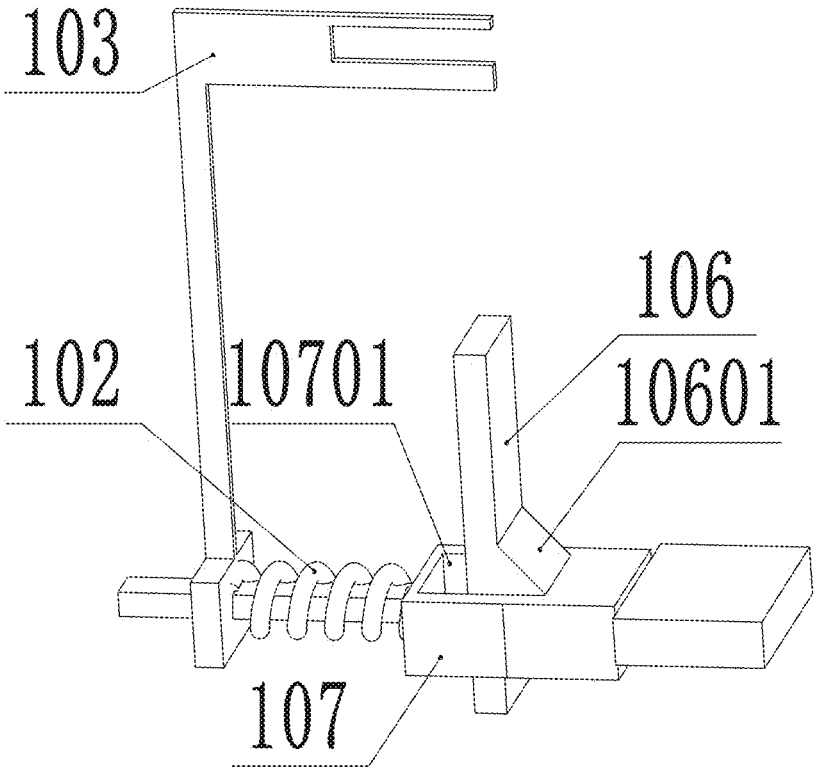
FIG. 5 is a schematic diagram of a part of an assembly structure of a connecting apparatus according to the present invention.

Specifically, as shown in FIGS. 4 to 5, a fixed disk 101, a fixed frame 103, an air cylinder 105 and a push rod 106 are arranged on the connecting apparatus 1. The fixed disk 101 is detachably and fixedly mounted at the bottom of the unmanned aerial vehicle 9 through screws (not shown in the figure). Ends of four fixed frames 103 are uniformly distributed and fixedly mounted on the fixed disk 101, and a limiting rod 107 is elastically and slidably mounted at the other end of the fixed frame 103 horizontally by a first spring 102. A sliding groove 602 corresponding to one end of the limiting rod 107 is arranged on the shell 6. Two air cylinders 105 are fixedly mounted on the fixed disk 101, and output ends of the two air cylinders 105 are fixedly connected to a moving plate 104. Four pushing rods 106 are fixedly mounted on the moving plate 104 corresponding to the four limiting rods 107. The limiting rod 107 is provided with a through hole 10701, one side of the through hole 10701 is an inclined plane, the push rod 106 vertically slides in the through hole 10701 of the limiting rod 107, and the push rod 106 is provided with an inclined surface a 10601 matched with the inclined surface of the through hole 10701 in the limiting rod 107 and is configured to push one end of the limiting rod 107 into the sliding groove 602 in the shell 6 under the drive of the air cylinder 105.

In an initial state, the fixed disk 101 is fixedly mounted on the unmanned aerial vehicle 9; the air cylinder 105 is started to drive the moving plate 104 to move upward, and further drive the 4 pushing rods 106 to move upward, so that the ends of the 4 limiting rods 107 are driven to be inserted into the sliding groove 602 of the shell 6, and the shell 6 is fixed. The unmanned aerial vehicle 9 takes off to drive the shell 6 to move. The sensor 7 on the shell 6 detects a suitable position away from the shipboard 11, and the air cylinder 105 is started to drive the push rod 106 to move downward. The limiting rod 107 slides out of the slide groove 602 of the shell 6 under the action of the first spring 102, and then the shell 6 falls.

Figure 6:
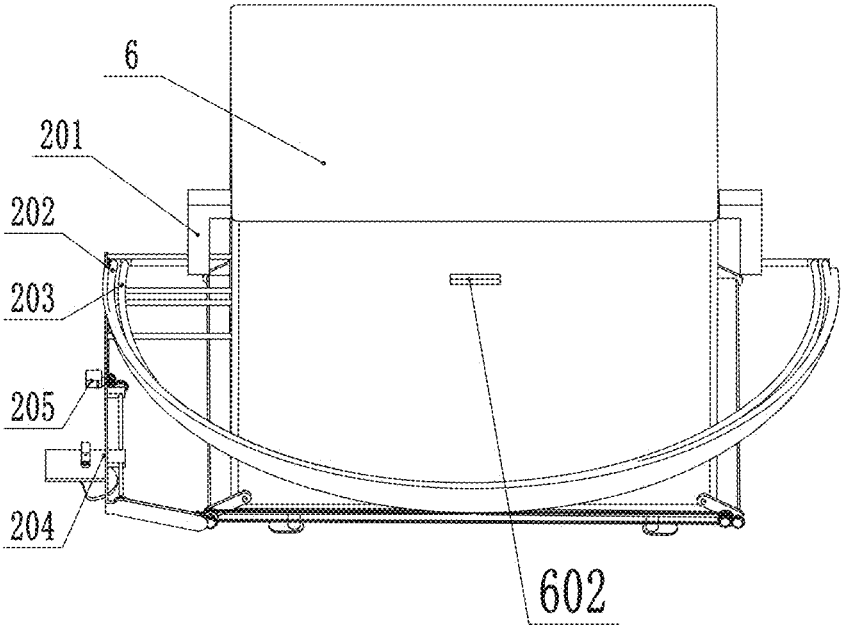
FIG. 6 is a schematic diagram of an assembly structure of a landing buffer apparatus and a shell according to the present invention.
Figure 7:
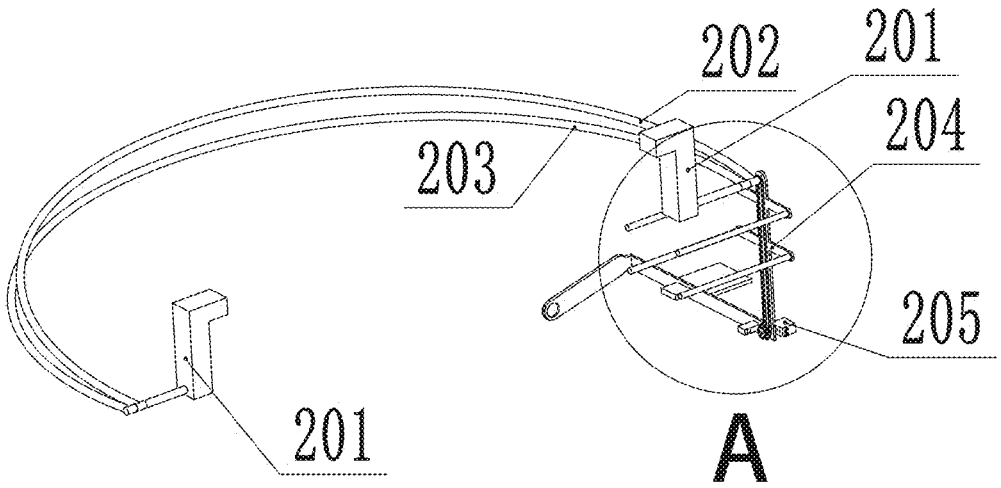
FIG. 7 is a schematic diagram of an assembly structure of a landing buffer apparatus according to the present invention.
Figure 8:
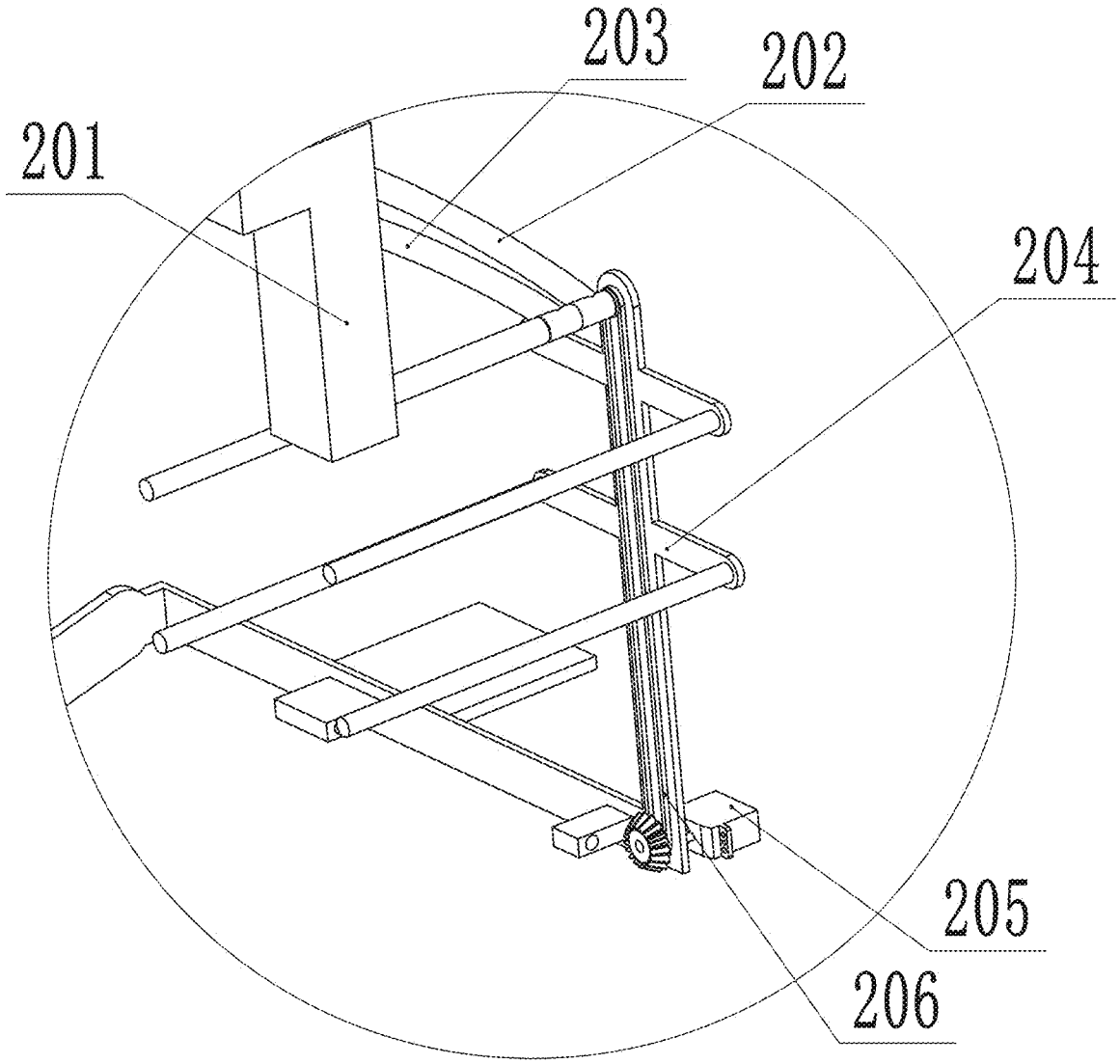
FIG. 8 is a schematic diagram of a partial enlarged structure of the position A in FIG. 7 according to the present invention.
Figure 9:
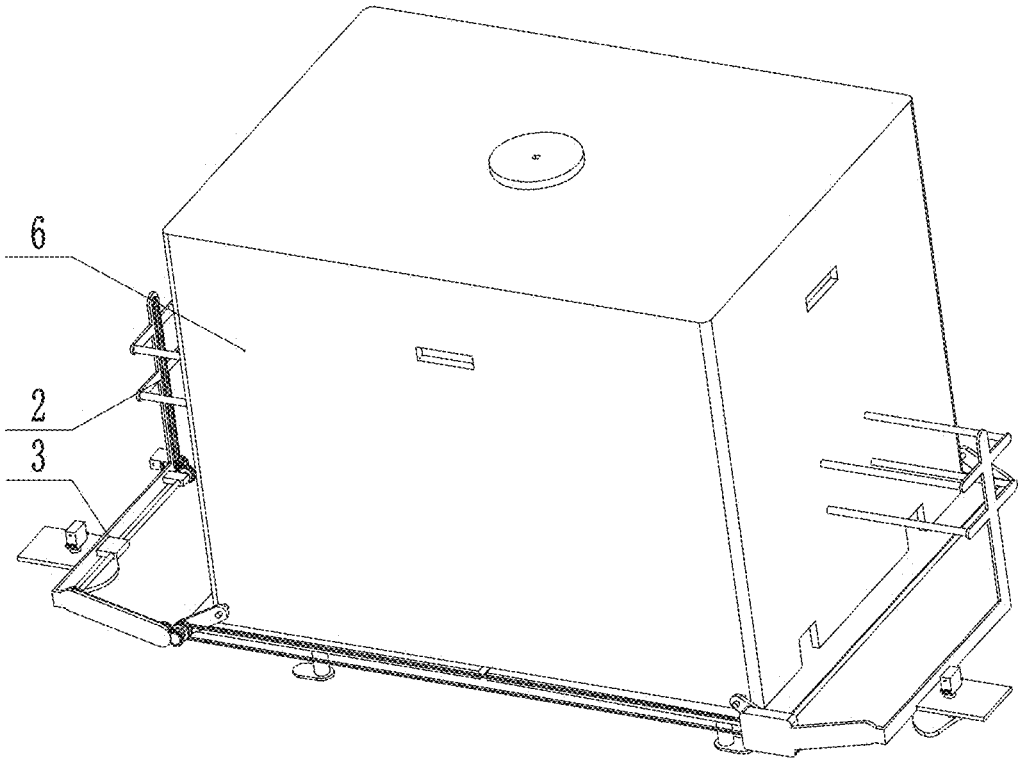
FIG. 9 is a schematic diagram of an assembly structure of a landing buffer apparatus, a fixing apparatus and a shell according to the present invention.
Figure 10:
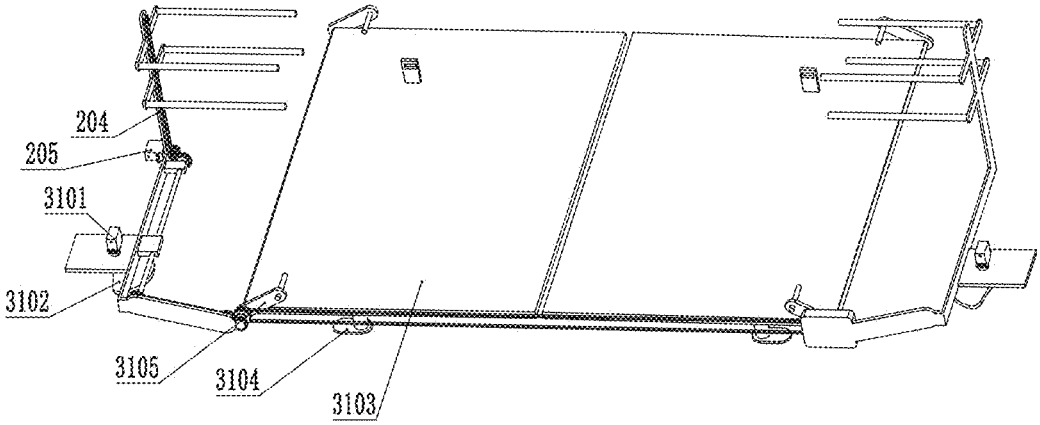
FIG. 10 is a schematic diagram of an assembly structure of a fixing apparatus according to the present invention.
Figure 11:
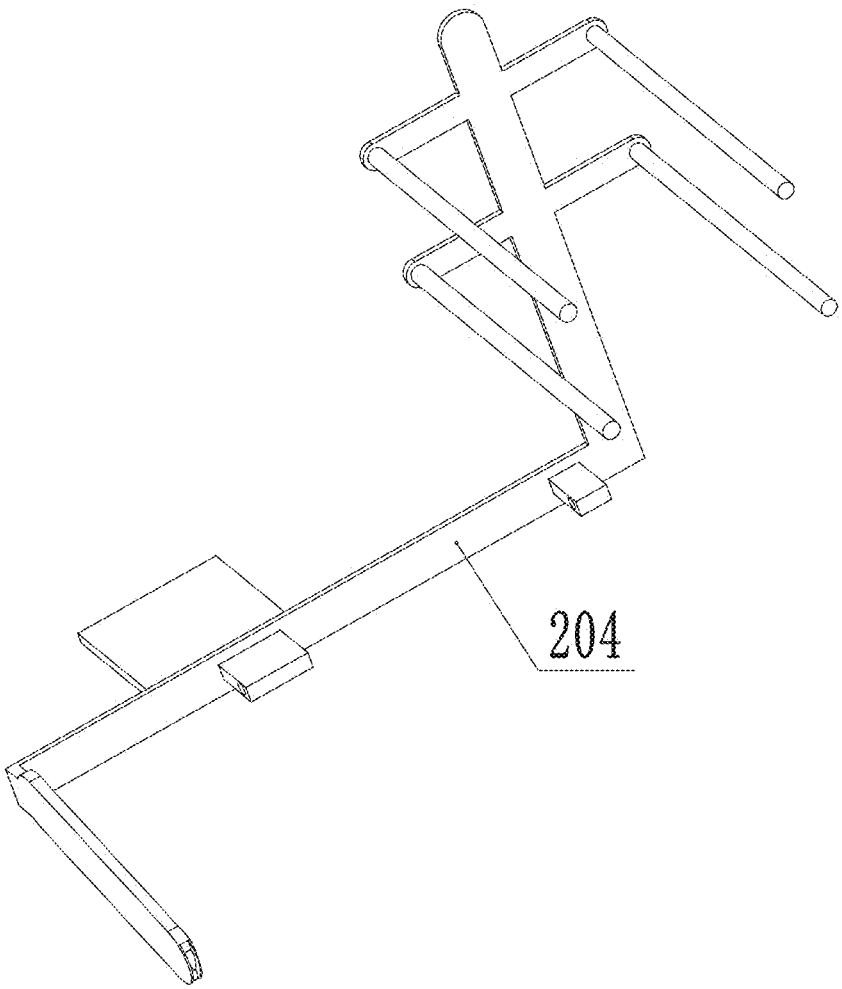
FIG. 11 is a schematic diagram of a structure of a third fixed frame according to the present invention.
Figure 23:
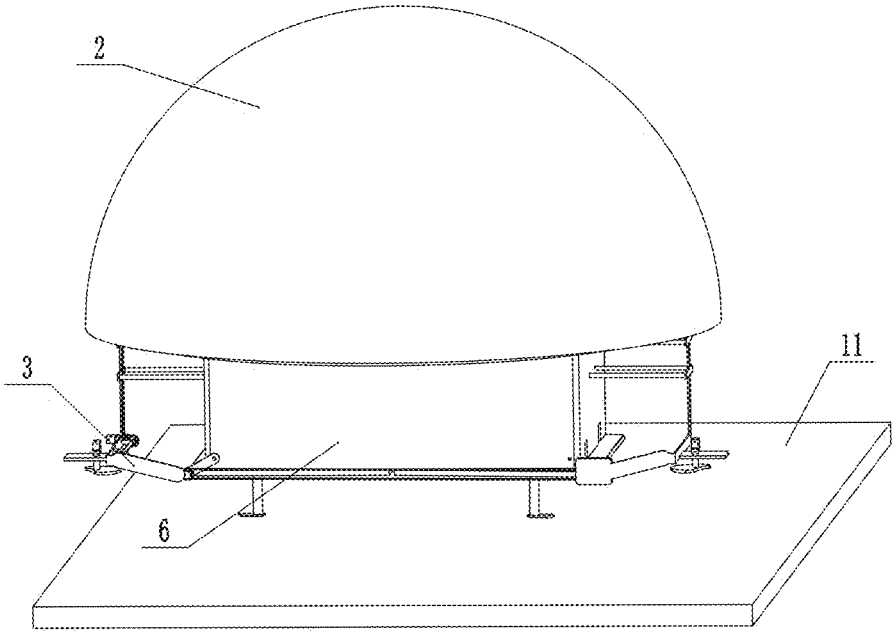
FIG. 23 is a schematic diagram of a structure of a landing buffer apparatus according to the present invention in the unfolded state.

Specifically, as shown in FIGS. 6 to 8, a second fixed frame 201, a first arc-shaped rod 202, a second arc-shaped rod 203, a third fixed frame 204 and a belt 206 are arranged on the landing buffer apparatus 2. The 2 second fixed frames 201 are symmetrically and fixedly mounted on the shell 6 in a front-back manner. Two ends of the second arc-shaped rod 203 are fixedly mounted on the second fixed frame 201, one end of the first arc-shaped rod 202 is rotatably mounted on the second fixed frame 201, and the other end of the first arc-shaped rod is rotatably mounted between the other second fixed frame 201 and the third fixed frame 204. A first motor 205 is fixedly mounted at the bottom end of the third fixed frame 204, and the output end of the first motor 205 is in transmission connection with one end of the corresponding first arc-shaped rod 202 by the belt 206. The first arc-shaped rod 202 and the second arc-shaped rod 203 are connected through soft fabric. When the shell falls to a certain extent, the first motor 205 rotates to further drive the first arc-shaped rod 202 to rotate 180 degrees, in this case, the first arc-shaped rod 202, the second arc-shaped rod 203 and the soft fabric between the two form a small parachute (as shown in FIG. 23), which can reduce the falling speed of the shell 6, and reduce the impact force applied when the shell 6 is landed on the shipboard 11, thereby protecting the adaptive navigation situation awareness device 10 in the shell 6 from damage.

In a specific implementation of this embodiment, to make the adaptive navigation situation awareness device 10 stably fixed on the shipboard 11 and move without being affected by the shaking of the hull, as shown in FIGS. 9 to 17, a driving mechanism 31A, a bottom plate 3103 and a support rod 3105 are arranged on the bottom plate turnover mechanism 31, wherein the driving mechanism 31A comprises a rotating shaft 3108, a second rotating shaft 3110, a third rotating shaft 3111, a fourth rotating shaft 3113 and a fifth rotating shaft 3114. The shell 6 is square, and the ends of the four support rods 3105 are symmetrically and fixedly mounted on four corners of the shell 6 respectively. The third rotating shaft 3111 is rotatably mounted between the two support rods 3105 at the front side, and the fifth rotating shaft 3114 is rotatably mounted between the two support rods 3105 at the rear side. The bottom plates 3103 are fixedly mounted on the third rotating shaft 3111 and the fifth rotating shaft 3114, and the fixing mechanisms 32 are fixedly mounted on the two bottom plates 3103 and are configured to fix the adaptive navigation situation awareness device 10.

The two third fixed frames 204 are symmetrically and fixedly mounted on the shell 6 in a front-back manner. A rotating shaft 3108 is rotatably mounted on the third fixed frame 204 at the front side, a first bevel gear 3106 is fixedly mounted on the output end of the first motor 205, a second bevel gear 3107 is fixedly mounted at one end of the rotating shaft 3108 corresponding to the first bevel gear 3106, and the first bevel gear 3106 is engaged with the second bevel gear 3107. The first motor 205 drives the rotating shaft 3108 to rotate.

A second rotating shaft 3110 is also rotatably mounted on the third fixed frame 204 at the front side, and the second rotating shaft 3110 is in transmission connection with the rotating shaft 3108 by a second belt 3109. One end of the second rotating shaft 3110 is fixedly connected to a first gear 311001, a second gear 311101 is fixedly mounted on one end of the third rotating shaft 3111 corresponding to the second rotating shaft 3110, and the second gear 311101 is engaged with the first gear 311001; that is, the first motor 205 drives the rotating shaft 3108 to rotate, and further drives the third rotating shaft 3111 to rotate. The third rotating shaft 3111 is fixedly connected to a bottom plate 3103, so that the bottom plate 3103 is driven to rotate.

Figure 13:
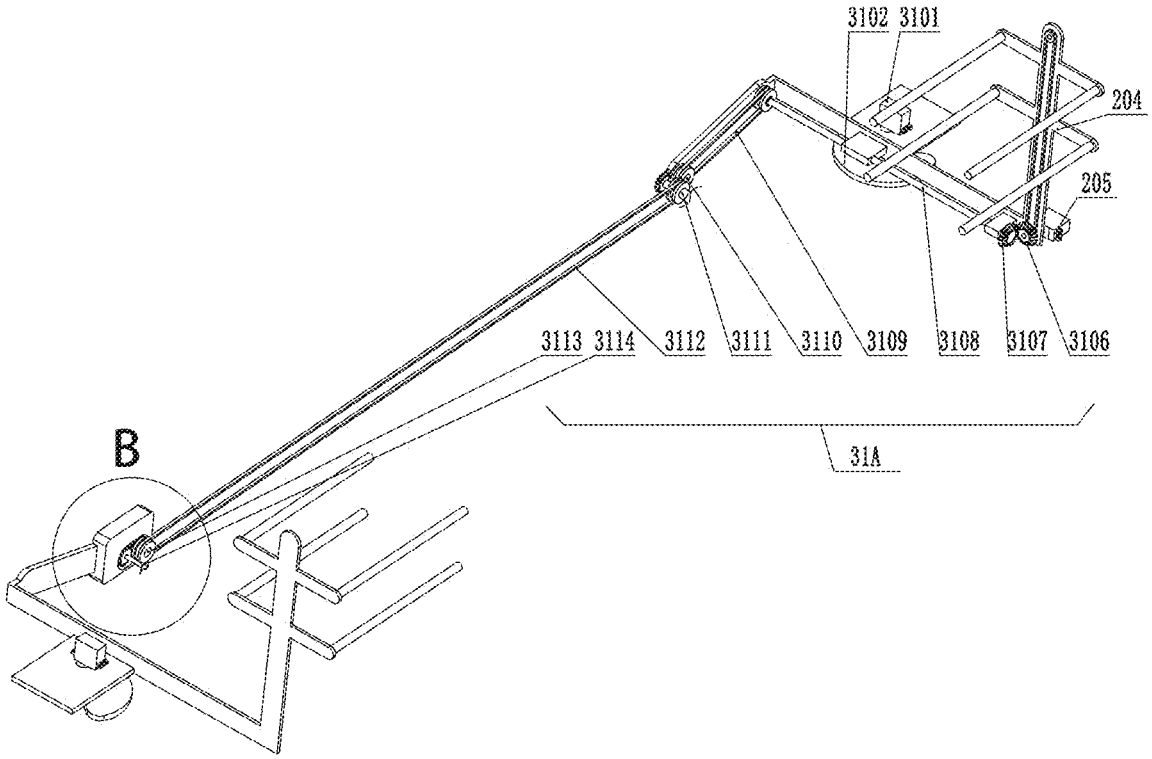
FIG. 13 is a schematic diagram of a part of an assembly structure of a bottom plate turnover mechanism according to the present invention.
Figure 14:
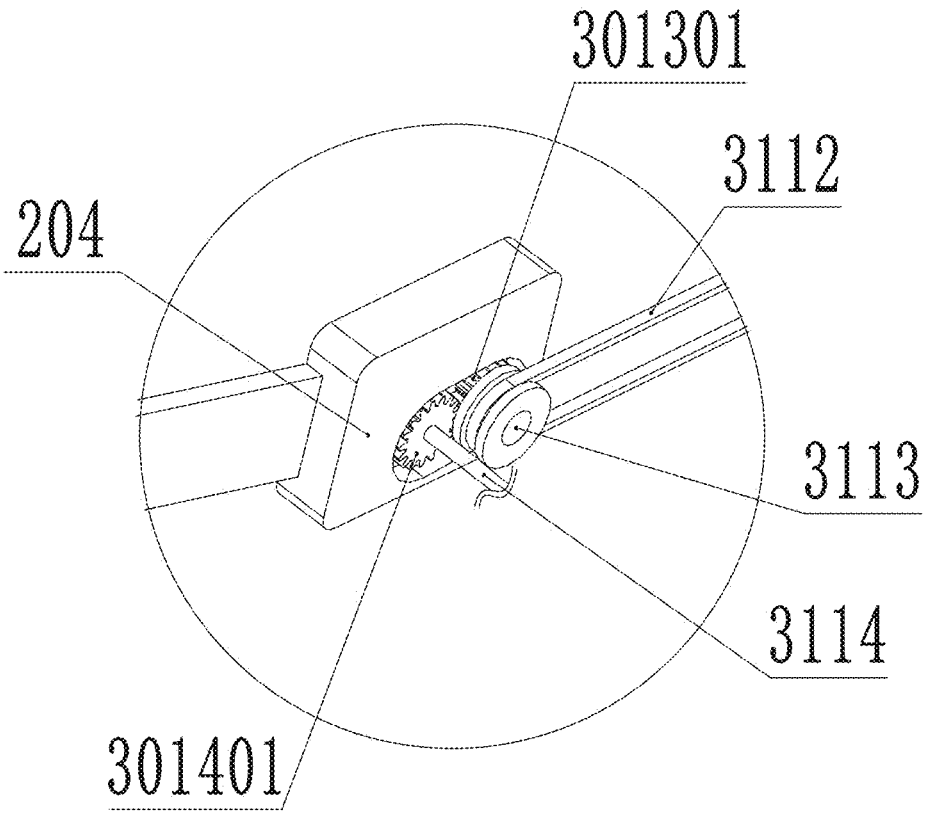
FIG. 14 is a schematic diagram of a partial enlarged structure of the position B in FIG. 13 according to the present invention.

In addition, as shown in FIGS. 13 to 14, a fourth rotating shaft 3113 is rotatably mounted on the third fixed frame 204 at the rear side, and the fourth rotating shaft 3113 is in transmission connection with the third rotating shaft 3111 by a third belt 3112. A third gear 311301 is fixedly mounted on the fourth rotating shaft 3113, a fourth gear 311401 is fixedly mounted at one end of the fifth rotating shaft 3114 corresponding to the fourth rotating shaft 3113, and the third gear 311301 is engaged with the fourth gear 311401. Therefore, the first motor 205 rotates to drive the third rotating shaft 3111 to rotate, and further drives the fifth rotating shaft 3114 to rotate, the bottom plate 3103 is fixedly mounted on the fifth rotating shaft 3114, and further the bottom plate 3103 is driven to rotate by the first motor 205.

In summary, the two bottom plates 3103 can be driven to rotate synchronously by the first motor 205; when the first motor 205 is rotating, the landing buffer apparatus is started synchronously, and the two bottom plates 3103 are overturned, and the first motor 205 drives the first arc-shaped rod 202 to rotate 180 degrees, and the landing buffer apparatus is started. In this case, two bottom plates 3103 rotate 180 degrees synchronously, from cooperating to block the opening 601 at the lower end of the shell 6 to removing the opening 601 at the lower end of the shell 6, and the two bottom plates 3103 are parallel to the shipboard 11.

Figure 12:
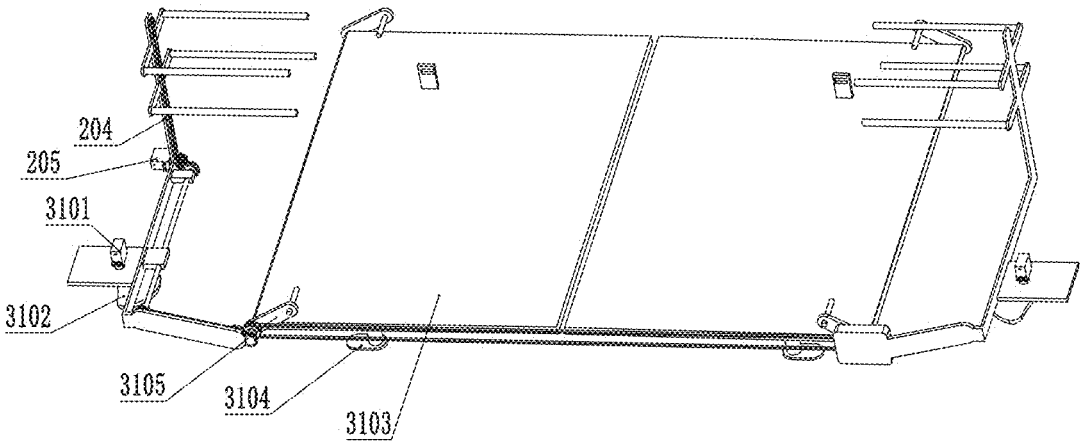
FIG. 12 is a schematic diagram of an assembly structure of a bottom plate turnover mechanism according to the present invention.
Figure 15:
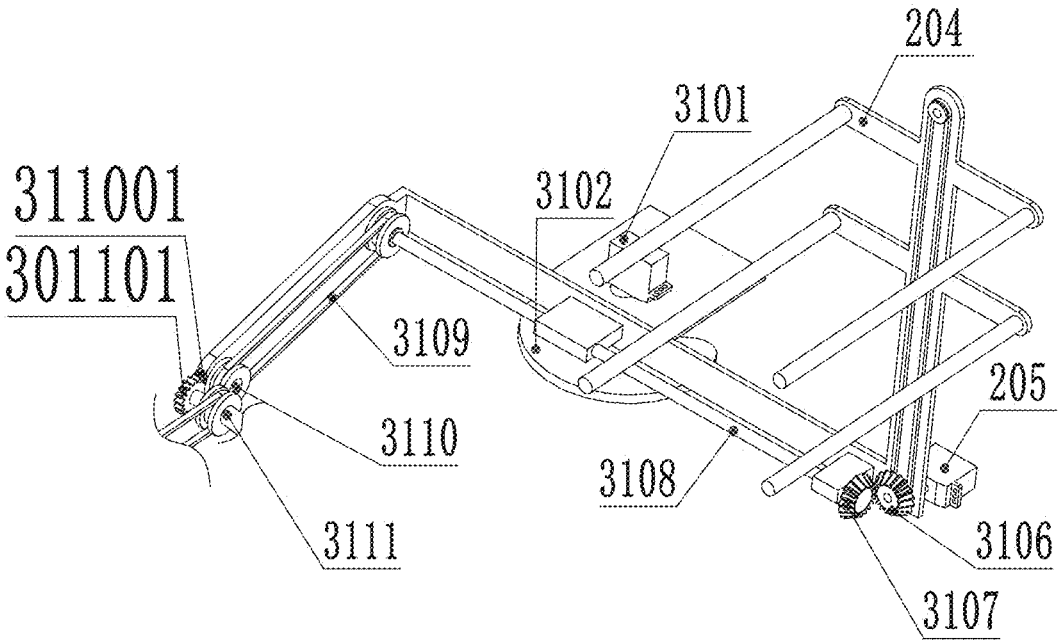
FIG. 15 is a schematic diagram of a partial assembly structure of a bottom plate turnover mechanism according to the present invention.
Figure 16:
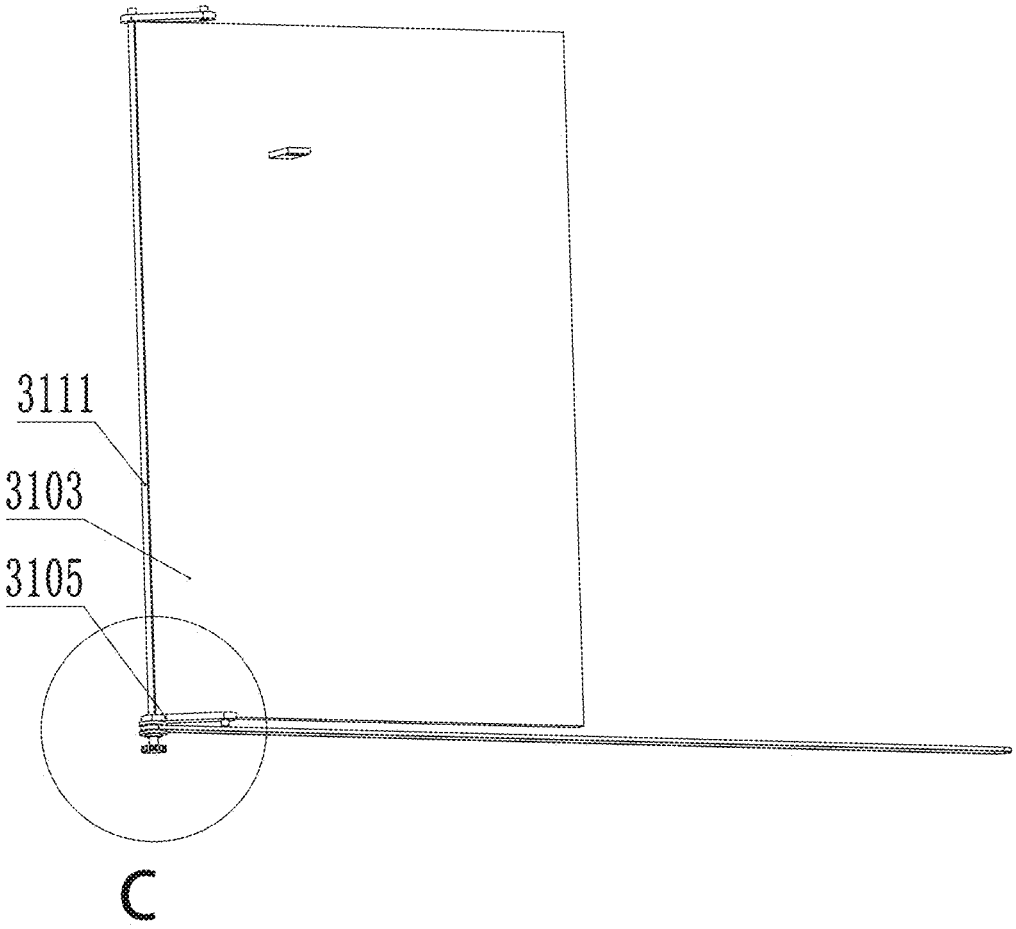
FIG. 16 is a schematic diagram of a partial assembly structure of a bottom plate turnover mechanism according to the present invention.
Figure 17:
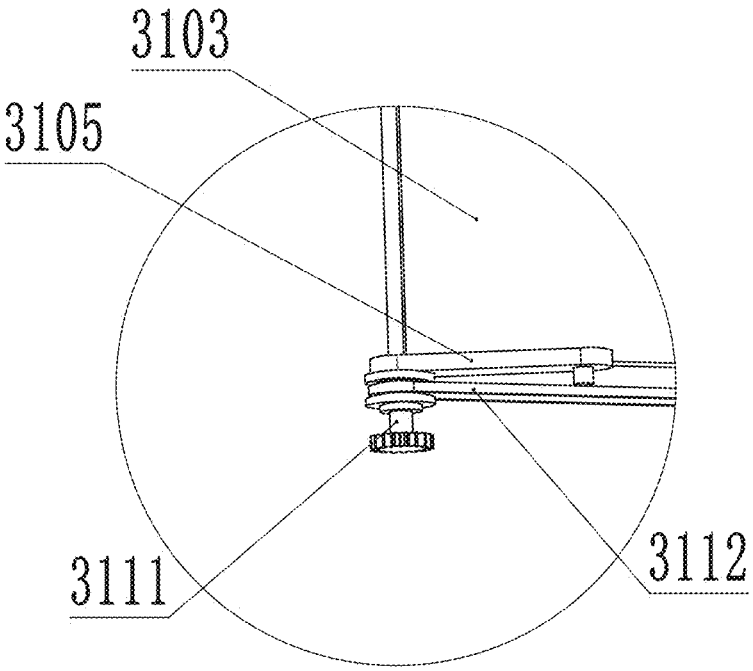
FIG. 17 is a schematic diagram of a partial enlarged structure of the position C in FIG. 16 according to the present invention.

In a specific implementation of this embodiment, to fix the overturned bottom plate 3103 more stably, as shown in FIGS. 12 to 13 and 15, special-shaped circular plates 3102 are rotatably mounted on two third fixed frames, and fixed rods 3104 are fixedly mounted on two bottom plates 3103. The two special-shaped circular plates 3102 are respectively driven by two second motors 3101 fixedly mounted on the third fixed frame 204, and are respectively intermittently matched with the two fixed rods 3104 to fix the two overturned bottom plates 3103. After the bottom plate 3103 rotates 180 degrees, the second motor 3101 drives the special-shaped circular plate 3102 to rotate, so that the special-shaped circular plate 3102 clamps the fixed rod 3104 to prevent the bottom plate 3103 from rotating toward the inside of the shell 6, thereby sealing the opening 601 at the bottom of the shell 6.

Figure 19:
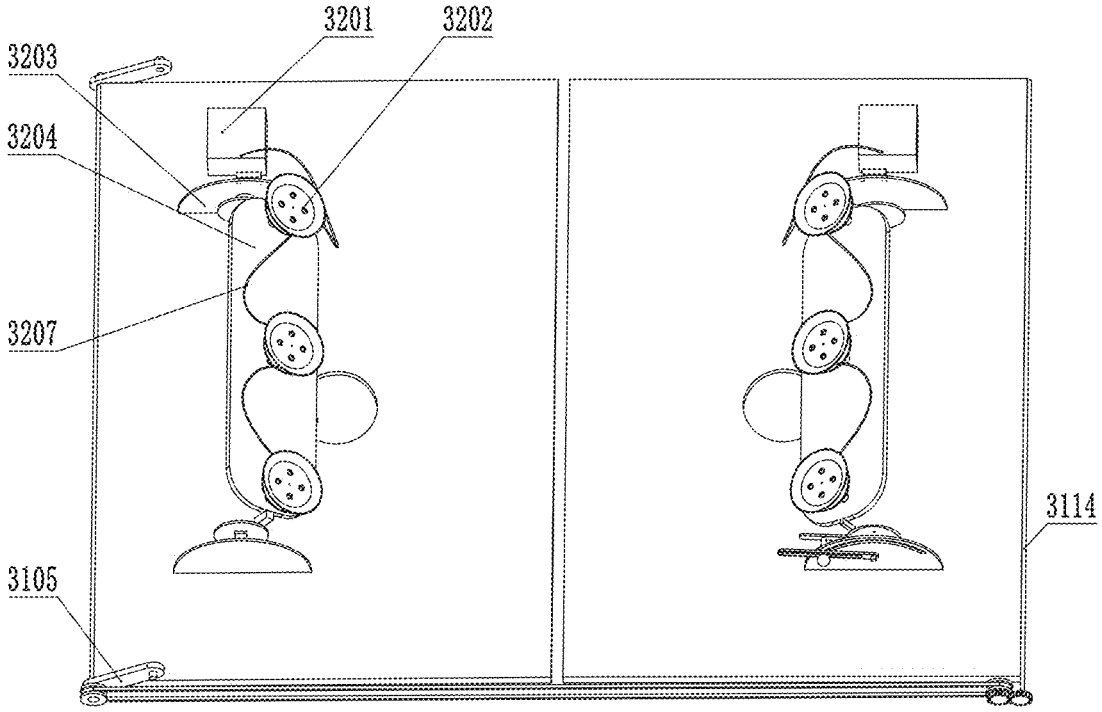
FIG. 19 is a schematic diagram of an assembly structure of a fixing mechanism according to the present invention.
Figure 20:
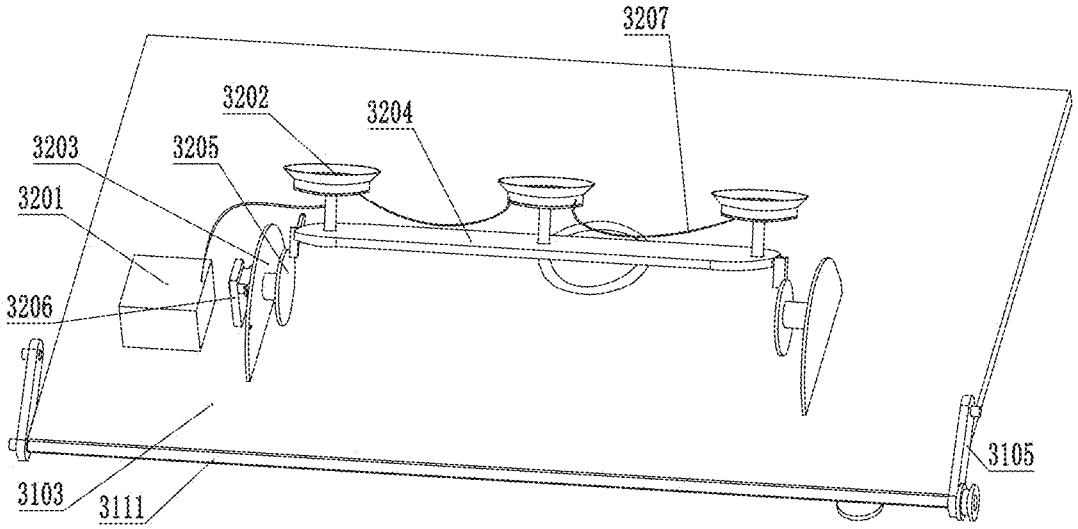
FIG. 20 is a schematic diagram of an assembly structure of a fixing mechanism according to the present invention.

Specifically, as shown in FIGS. 19 to 20, two fixing mechanisms 32 are symmetrically and fixedly mounted on the base plate 3103; and each of the fixing mechanisms 32 is provided with an air pump 3201, a support frame 3203, a fixed plate 3204, a rotating disk 3205 and a third motor 3206. Two support frames 3203 are symmetrically and fixedly mounted on the bottom plate 3103. The two rotating disks 3205 are rotatably mounted on the support frame 3203 and are driven by a third motor 3206 fixedly mounted on the bottom plate 3103. The fixed plate 3204 is fixedly mounted between the two rotating disks 3205. 3 suction disks 3202 are fixedly mounted on the fixed plate 3204, the 3 suction disks 3202 are connected in series by an air pipe 3207, and one end of the air pipe 3207 is connected to the air pump 3201. In a specific implementation of this embodiment, the model of air pump 3201 is an SJA micro vacuum pump.

In an initial state, the adaptive navigation situation awareness device 10 is fixedly mounted on the suction disks 3202 of the two fixing mechanisms 32. When the bottom plate 3103 is rotated, the air pump 3201 inflates air between the suction disks 3202 and the adaptive navigation situation awareness device, so that the suction disks 3202 are separated from the adaptive navigation situation awareness device 10. After the rotation of the bottom plate 3103 is completed, the third motor 3206 rotates to drive the rotating disk 3205 to rotate and further drive the fixed plate 3204 to rotate, so that the suction disks 3202 on the fixed plate 3204 are perpendicular to the shipboard 11. When this apparatus is landed on the shipboard 11, the suction disks 3202 abut against the shipboard, the air pump 3201 is started to suck air between the suction disks 3202 and the shipboard 11, and the apparatus in this embodiment is fixed on the shipboard 11.

Figure 18:
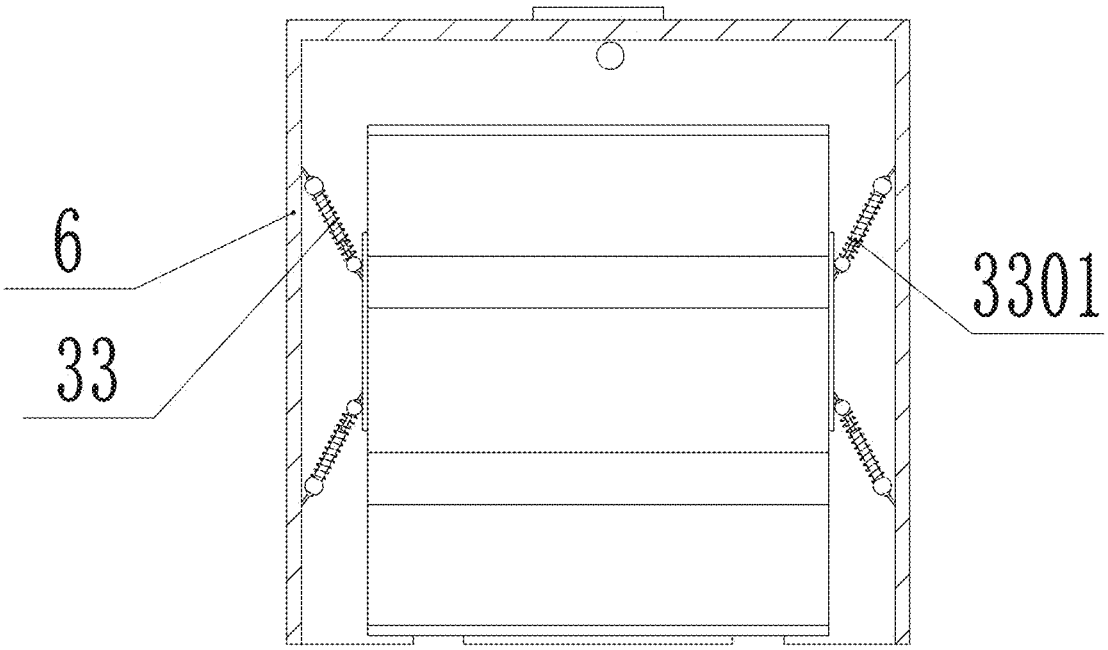
FIG. 18 is a schematic diagram of an assembly structure of a spring, a shell and an adaptive navigation situation awareness device according to the present invention.

Specifically, as shown in FIG. 18, the adaptive navigation situation awareness device 10 is mounted inside the shell 6 and fixed by a second fixing mechanism 33, wherein the second fixing mechanism 33 comprises a second spring 3301. 4 second springs 3301 are symmetrically distributed in the front and back of the adaptive navigation situation awareness device 10, the springs on the front side and the rear side are symmetrically distributed in the up-and-down direction, one end of each spring is fixedly connected to the inside of the shell 6, and the other end of each spring is fixedly connected to the outside of the adaptive navigation situation awareness device 10. When the fixing mechanism 32 is separated from the adaptive navigation situation awareness device 10, the adaptive navigation situation awareness device 10 is elastically mounted inside the shell 6 by the second springs 3301. The second springs 3301 can ensure that the adaptive navigation situation awareness device 10 is mounted inside the shell 6 without falling off, and effectively reduce the impact on the adaptive navigation situation awareness device 10 when this device is landed on the shipboard 11, thereby increasing the safety of throwing the adaptive navigation situation awareness device 10.

Figure 21:
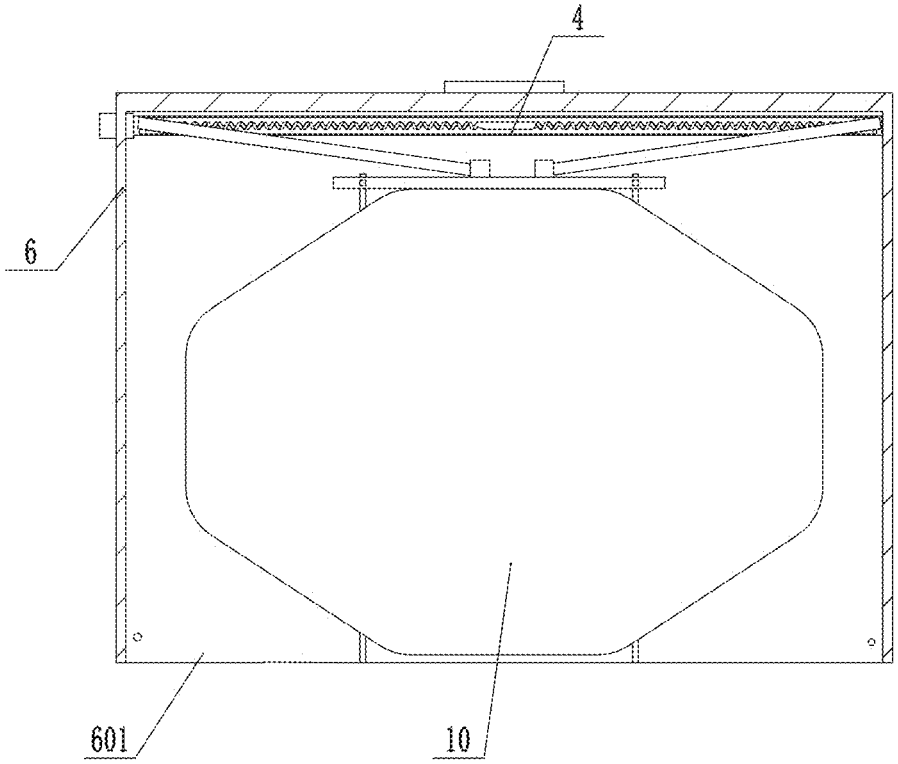
FIG. 21 is a schematic diagram of an assembly structure of a pressing apparatus, a shell and an adaptive navigation situation awareness device according to the present invention.
Figure 22:
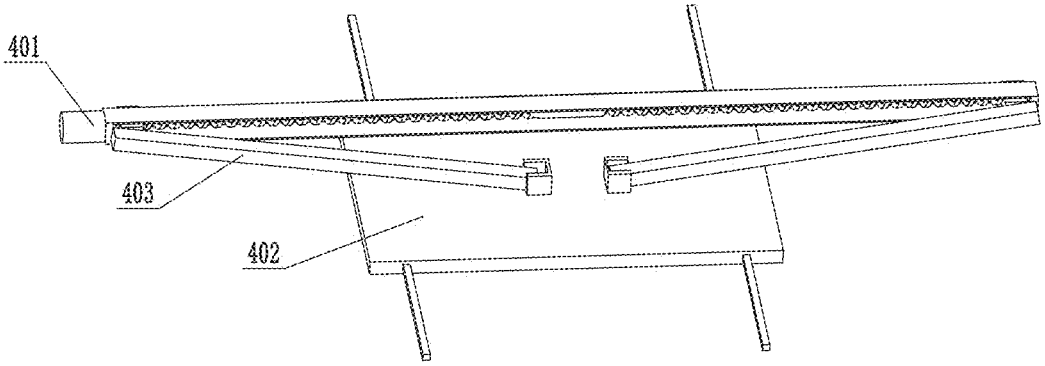
FIG. 22 is a schematic diagram of an assembly structure of a pressing apparatus according to the present invention.

In addition, to enable the adaptive navigation situation awareness device 10 to tightly attach to the hull so as to detect more real and effective data, as shown in FIGS. 21 to 22, a pressing apparatus 4 is mounted at an upper end inside the shell 6; and an electric lead screw apparatus 401, a pressing plate 402 and a sliding rod 403 are arranged on the pressing apparatus 4. The electric lead screw apparatus 401 is mounted at the upper end inside the shell 6, and the lead screw is divided into forward and reverse rotation threads from the middle position. The pressing plate 402 is mounted inside the shell 6 in an up-and-down sliding manner, corresponds to the adaptive navigation situation awareness device 10, and is positioned at the upper end of the adaptive navigation situation awareness device 10. One end of each of the two sliding rods 403 is connected to one of the rotation threads, and synchronous movement in the same direction or opposite direction is achieved under the rotation of the electric lead screw apparatus 401. The other end of each of the two sliding rods 403 is rotatably mounted on the pressing plate 402, and the pressing plate 402 is driven by the electric lead screw apparatus 401 to move up and down.

When this device is landed on the shipboard 11, this device is fixed by the fixing apparatus, the electric lead screw apparatus 401 is started to drive the pressing plate 402 to move downward, so that the pressing plate 402 drives the adaptive navigation situation awareness device 10 to move downward and further tightly attach to the shipboard 11. Since the adaptive navigation situation awareness device 10 is elastically connected to the inside of the shell 6 by the second spring 3301, this device can be tightly attached to the ship board 11 under the drive of the pressure plate 402.

To prevent the occurrence of accidents, an air bag 5 is fixedly mounted at the lower end of the outside of the shell 6, so that this apparatus can float on the sea surface when falling into the sea, thereby facilitating salvage.

The first motor 205, the second motor 3101, the air pump 3201, the electric lead screw apparatus 401 and the sensor 7 are all electrically connected to the control apparatus 8.

Rationale:

In an initial state, the adaptive navigation situation awareness device 10 is mounted inside the shell 6, and the connecting apparatus 1 is fixedly mounted at the bottom of the unmanned aerial vehicle 9;

step I: the shell 6 is fixedly mounted on the connecting apparatus 1 by the operator, and the unmanned aerial vehicle is started to drive the shell 6 to move;

step II: the sensor is started, and the air pump 3201 is started to separate the suction disk 3202 from the adaptive navigation situation awareness device 10; after a proper distance is detected, the first motor 205 is started to drive the landing buffer apparatus to start, and synchronously drive the bottom plate 3103 to overturn;

step III: after the bottom plate 3103 is overturned, the second motor 3101 is started to drive the special-shaped circular plate 3102 to fix the bottom plate 3103; the third motor 3206 is started to drive the suction disk 3202 to rotate;

step IV: when this device is landed on the shipboard 11, the air pump 3201 is started to fix the suction disk 3202 with the shipboard 11; and step V: the electric lead screw apparatus 401 is started to drive the pressing plate 402 to press the adaptive navigation situation awareness device 10 against the shipboard 11.

The above description is merely preferred implementation of this embodiment, but is not intended to limit the protection scope of this embodiment. Any equivalent replacements or changes made by any of those familiar with the technical field within the technical scope disclosed by this embodiment according to the technical solutions and the inventive concepts of this embodiment shall fall within the protection scope of this embodiment.

What is claimed is:

1. A throwing protection apparatus for an adaptive navigation situation awareness device based on ship pilotage, comprising: a connecting apparatus, a landing buffer apparatus, a fixing apparatus, a pressing apparatus, a shell and a control apparatus; wherein a bottom of the shell is provided with an opening for the adaptive navigation situation awareness device to pass through; one end of the connecting apparatus is fixedly connected to an unmanned aerial vehicle, and the other end of the connecting apparatus is slidably connected to the shell; the adaptive navigation situation awareness device is arranged in the shell and is fixed by the fixing apparatus arranged on the shell; the pressing apparatus is mounted on the shell, is positioned above the adaptive navigation situation awareness device and is configured to press the adaptive navigation situation awareness device downward; the landing buffer apparatus is mounted outside the shell;

a bottom plate turnover mechanism, a fixing mechanism and a second fixing mechanism are arranged on the fixing apparatus; the bottom plate turnover mechanism is rotatably mounted at a bottom end of the shell, and the fixing mechanism is fixedly mounted on the bottom plate turnover mechanism; when the bottom plate turnover mechanism is at a certain distance from a shipboard, the bottom plate turnover mechanism rotates to enable the fixing mechanism to be perpendicular to the shipboard, and the fixing mechanism fixedly mount the throwing protection apparatus for the adaptive navigation situation awareness device on the shipboard; the second fixing mechanism is fixedly connected between the shell and the adaptive navigation situation awareness device;

an air bag and a distance measuring sensor are fixedly mounted on the shell;

a second fixed frame, a first arc-shaped rod, a second arc-shaped rod and a third fixed frame are arranged on the landing buffer apparatus; two second fixed frames are symmetrically and fixedly mounted on the shell in a front-back manner; the third fixed frame is fixedly mounted on the shell; two ends of the second arc-shaped rod are fixedly mounted on the second fixed frame; two ends of the first arc-shaped rod are rotatably mounted on the second fixed frame, correspond to the second arc-shaped rod and are driven by a first motor fixedly mounted on the third fixed frame; the first arc-shaped rod and the second arc-shaped rod are connected by soft fabric;

a driving mechanism, a bottom plate and a support rod are arranged on the bottom plate turnover mechanism; ends of four support rods are symmetrically and fixedly mounted on the shell in a front-back manner; two third fixed frames are symmetrically and fixedly mounted on the shell in a front-back manner; two bottom plates are symmetrically arranged in a front-back manner, are rotatably mounted between the support rods at corresponding left and right sides, and are synchronously driven by the driving mechanism mounted on the third fixed frame;

a special-shaped circular plate and a fixed rod are arranged on the bottom plate turnover mechanism; two fixed rods are fixedly mounted on the bottom plate; two special-shaped circular plates are fixedly mounted on the third fixed frame, are driven by a corresponding second motor fixedly mounted on the third fixed frame, and are intermittently matched with a fixed rod to fix two overturned bottom plates; and the control apparatus is configured to control the operation of the entire throwing protection apparatus for the adaptive navigation situation awareness device based on ship pilotage except for the control apparatus.

2. The throwing protection apparatus for the adaptive navigation situation awareness device based on ship pilotage according to claim 1, wherein a fixed disk, a fixed frame, an air cylinder and a push rod are arranged on the connecting apparatus; the fixed disk is fixedly mounted on the unmanned aerial vehicle; at least two fixed frames are uniformly distributed and fixedly mounted on the fixed disk, and a limiting rod is elastically and slidably mounted at the other end of the fixed frame horizontally; the shell is provided with a sliding groove corresponding to one end of the limiting rod; the number of the push rods corresponds to that of the limiting rods; the limiting rod is provided with a through hole, and the push rod is slidably mounted in the through hole of the limiting rod and is driven by the air cylinder fixedly mounted on the fixed disk; and the push rod is provided with an inclined plane a and is configured to push one end of the limiting rod into the sliding groove in the shell under the drive of the air cylinder.

3. The throwing protection apparatus for the adaptive navigation situation awareness device based on ship pilotage according to claim 1, wherein a rotating shaft, a second rotating shaft, a third rotating shaft, a fourth rotating shaft and a fifth rotating shaft are arranged on the driving mechanism; the rotating shaft and the second rotating shaft are rotatably mounted on the third fixed frame at a front side and are in transmission connection by a second belt to achieve synchronous rotation; an output end of the first motor is fixedly connected to a first bevel gear, one end of the rotating shaft is fixedly connected to a second bevel gear, and the first bevel gear is engaged with the second bevel gear;

the third rotating shaft is rotatably mounted between two support rods at a front side and is fixedly connected to the bottom plate between the two support rods; a first gear is fixedly mounted on the second rotating shaft, and a second gear is fixedly mounted on one end of the third rotating shaft corresponding to the second rotating shaft; the first gear is engaged with the second gear;

the fourth rotating shaft is rotatably mounted on the third fixed frame at a rear side and is in transmission connection with the third rotating shaft through a third belt;

the fifth rotating shaft is rotatably mounted between two support rods at a rear side and is fixedly connected to the bottom plate between the two support rods; a third gear is fixedly mounted on the fourth rotating shaft, and a fourth gear is fixedly mounted at one end of the fifth rotating shaft corresponding to the fourth rotating shaft; and the third gear is engaged with the fourth gear.

4. The throwing protection apparatus for the adaptive navigation situation awareness device based on ship pilotage according to claim 1, wherein two fixing mechanisms are symmetrically and fixedly mounted on the bottom plate; each of the fixing mechanisms is provided with an air pump, a support frame, a fixed plate, a rotating disk and a third motor; two support frames are symmetrically and fixedly mounted on the bottom plate; two rotating disks are rotatably mounted on the support frame and are driven by the third motor fixedly mounted on the bottom plate; the fixed plate is fixedly mounted between the two rotating disks; and a plurality of suction disks are fixedly mounted on the fixed plate and are connected in series through an air pipe, and one end of the air pipe is connected to the air pump.

5. The throwing protection apparatus for the adaptive navigation situation awareness device based on ship pilotage according to claim 1, wherein an electric lead screw apparatus and a pressing plate are arranged on the pressing apparatus; the electric lead screw apparatus is mounted on the shell; and the pressing plate is mounted inside the shell in an up-and-down sliding manner, corresponds to the adaptive navigation situation awareness device, is positioned at an upper end of the adaptive navigation situation awareness device, and is driven by the electric lead screw apparatus.

6. The throwing protection apparatus for the adaptive navigation situation awareness device based on ship pilotage according to claim 1, wherein the second fixing mechanism comprises a second spring; and a plurality of the second springs are symmetrically distributed in front and behind the adaptive navigation situation awareness device, one end of each of the springs is fixedly connected to the inside of the shell, and the other end of each of the springs is fixedly connected to the outside of the adaptive navigation situation awareness device.

* * * * *